US009757771B2

(12) United States Patent
Dickinson et al.

(10) Patent No.: US 9,757,771 B2
(45) Date of Patent: Sep. 12, 2017

(54) VIBRATORY APPARATUS WITH DYNAMIC BALANCER AND BALANCING METHOD

(71) Applicant: General Kinematics Corporation, Crystal Lake, IL (US)

(72) Inventors: Eric Dickinson, Cary, IL (US); Yong Wei, Crystal Lake, IL (US); Steve Massman, Poplar Grove, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 0 days.

(21) Appl. No.: 15/246,142

(22) Filed: Aug. 24, 2016

(65) Prior Publication Data

US 2016/0361737 A1 Dec. 15, 2016

Related U.S. Application Data

(63) Continuation of application No. 14/557,641, filed on Dec. 2, 2014, now Pat. No. 9,427,781.

(60) Provisional application No. 61/910,943, filed on Dec. 2, 2013.

(51) Int. Cl.

| | |
|---|---|
| ***B07B 1/44*** | (2006.01) |
| ***B07B 1/28*** | (2006.01) |
| ***B07B 1/30*** | (2006.01) |

(52) U.S. Cl.

CPC ..... *B07B 1/44* (2013.01); *B07B 1/284* (2013.01); *B07B 1/286* (2013.01); *B07B 1/30* (2013.01)

(58) Field of Classification Search

CPC ..... B07B 1/44
USPC ..... 209/367
See application file for complete search history.

(56) References Cited

U.S. PATENT DOCUMENTS

| | | | | |
|---|---|---|---|---|
| 1,726,192 | A | 8/1929 | Richardson | |
| 1,924,111 | A * | 8/1933 | Erickson | A23N 15/02 426/484 |
| 2,058,833 | A * | 10/1936 | Kuhlengel | B07B 1/284 209/326 |
| 2,066,362 | A | 1/1937 | Parks | |
| 2,386,579 | A * | 10/1945 | Wheeler | B07B 1/286 209/314 |
| 2,958,228 | A * | 11/1960 | Carrier, Jr. | B06B 1/161 198/766 |
| 2,993,585 | A | 7/1961 | Musschoot | |
| 3,194,390 | A | 7/1965 | Allen et al. | |

(Continued)

FOREIGN PATENT DOCUMENTS

| | | |
|---|---|---|
| DE | 666453 | 10/1938 |
| GB | 795081 | 5/1958 |
| JP | 2013095597 | 5/2013 |

OTHER PUBLICATIONS

International Search Report and Written Opinion, counterpart International Appl. No. PCT/US2014/068098, dated Mar. 3, 2015 (11 pages).

*Primary Examiner* — Terrell Matthews
(74) *Attorney, Agent, or Firm* — Cook Alex Ltd.

(57) ABSTRACT

A vibratory apparatus including a trough having one or more decks, with an inlet end and an outlet end, a first plurality of isolation springs disposed between the trough and ground, and a two-mass, sub-resonant frequency exciter supported on the trough. The trough and the exciter move 180-degrees out of phase with each other. The apparatus also includes a dynamic balancer including a plurality of isolation springs disposed between the exciter and ground.

4 Claims, 4 Drawing Sheets

(56) References Cited

U.S. PATENT DOCUMENTS

| | | | | | |
|---|---|---|---|---|---|
| 3,235,078 | A | * | 2/1966 | Hostetler | B07B 1/005 209/315 |
| 3,238,798 | A | * | 3/1966 | Yeasting | B07B 1/40 198/759 |
| 3,552,545 | A | | 1/1971 | Hartman | |
| 4,287,056 | A | * | 9/1981 | Dumbaugh | B07B 1/42 198/762 |
| 4,378,064 | A | | 3/1983 | Brown | |
| 4,981,220 | A | * | 1/1991 | Kolodesh | A23N 1/003 209/691 |
| 5,054,606 | A | | 10/1991 | Musschoot | |
| 5,056,652 | A | | 10/1991 | Kraus et al. | |
| 5,713,457 | A | | 2/1998 | Musschoot | |
| 7,322,569 | B2 | | 1/2008 | Kraus | |
| 7,581,646 | B2 | * | 9/2009 | Barr | B07B 1/12 209/235 |
| 8,528,189 | B1 | | 9/2013 | Smith et al. | |
| 9,079,222 | B2 | | 7/2015 | Burnett et al. | |
| 2009/0179134 | A1 | | 7/2009 | Britton et al. | |
| 2010/0135103 | A1 | | 6/2010 | Mathis, Jr. et al. | |

* cited by examiner

VIBRATORY APPARATUS WITH DYNAMIC BALANCER AND BALANCING METHOD

BACKGROUND

This patent is directed to a dynamic balancer for a vibratory apparatus and a method for balancing a vibratory apparatus, and, in particular, to a dynamic balancer for a vibratory screening apparatus and a balancing method for the same.

For many years, mining operations have used brute force vibratory screening units to separate the materials generated by upstream crushing and/or grinding operations so that these materials may be further processed downstream to extract metal from ore. A brute force, or direct drive, screening unit is one in which the exciter is secured or bolted to the trough (or driven mass). Such units housed in large processing buildings or plants have been used to process, for example, 1000 tons/hour of rock to separate out the desired amount of metal.

Coincident with the recent introduction and commercialization of large capacity grinding mills, lower quality ore bodies are being processed. This results in considerably more material being processed to obtain the same amount of metal from higher quality ore bodies. As a consequence, these direct drive units have had to handle significantly more material, with processing rates doubling or tripling as a result.

To handle the increased processing demands, the industry has seen a shift to larger and larger units. Where a direct drive unit screening unit with a 2 meter width may have been used in the past, a direct drive unit with a 4 meter width is used now to accommodate the increased loading. Increases in size have associated and related increases in the power requirement for the screening unit.

Unfortunately, direct drive units dampen under load. That is, as the loading increases, the stroke of the unit decreases. As a further consequence, more of the energy of the screening unit is directed through the drive bracket into the side panels. This can lead to premature failure of the apparatus and loss of available processing time and resultant revenues while increasing the required maintenance time and costs.

SUMMARY

According to one aspect of the present disclosure, a vibratory apparatus includes a trough having one or more decks, with an inlet end and an outlet end, a first plurality of isolation springs disposed between the trough and ground, and a two-mass, sub-resonant frequency exciter supported on the trough. The trough and the exciter move 180-degrees out of phase with each other. The apparatus also includes a dynamic balancer including a plurality of isolation springs disposed between the exciter and ground.

According to another aspect of the present disclosure, a method of operating a vibratory apparatus includes operating a two-mass, sub-resonant frequency exciter coupled to a trough, the trough supported on a first plurality of isolation springs disposed between the trough and ground, the two-mass, sub-resonant frequency exciter moving 180-degrees out of phase with the trough. The method also includes coupling the exciter to ground through a dynamic balancer comprising a plurality of isolation springs disposed between the exciter and ground.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Figure 1:
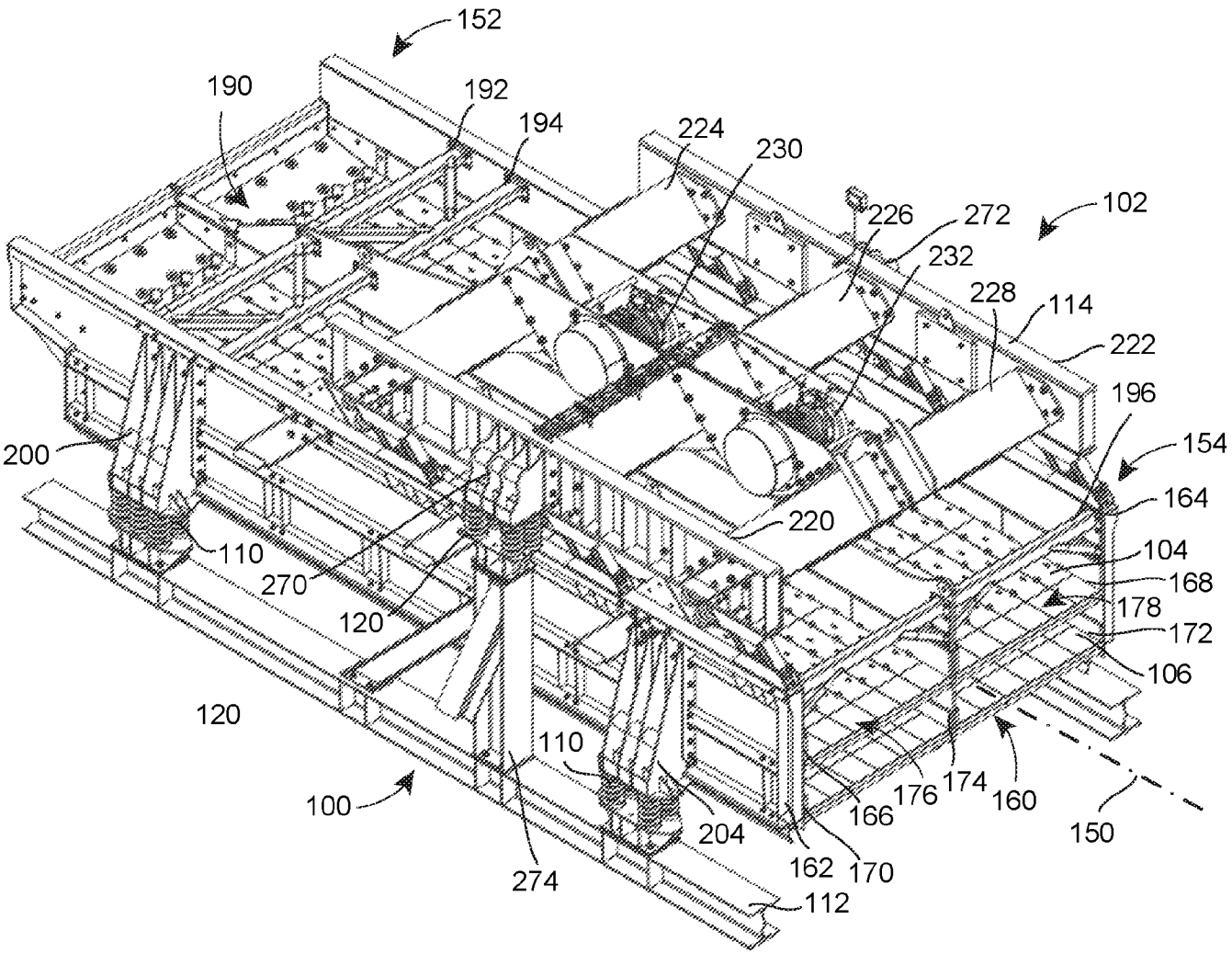
FIG. 1 is a perspective view of a vibratory apparatus, such as a vibratory screening apparatus, with an attached dynamic balancer.
Figure 2:
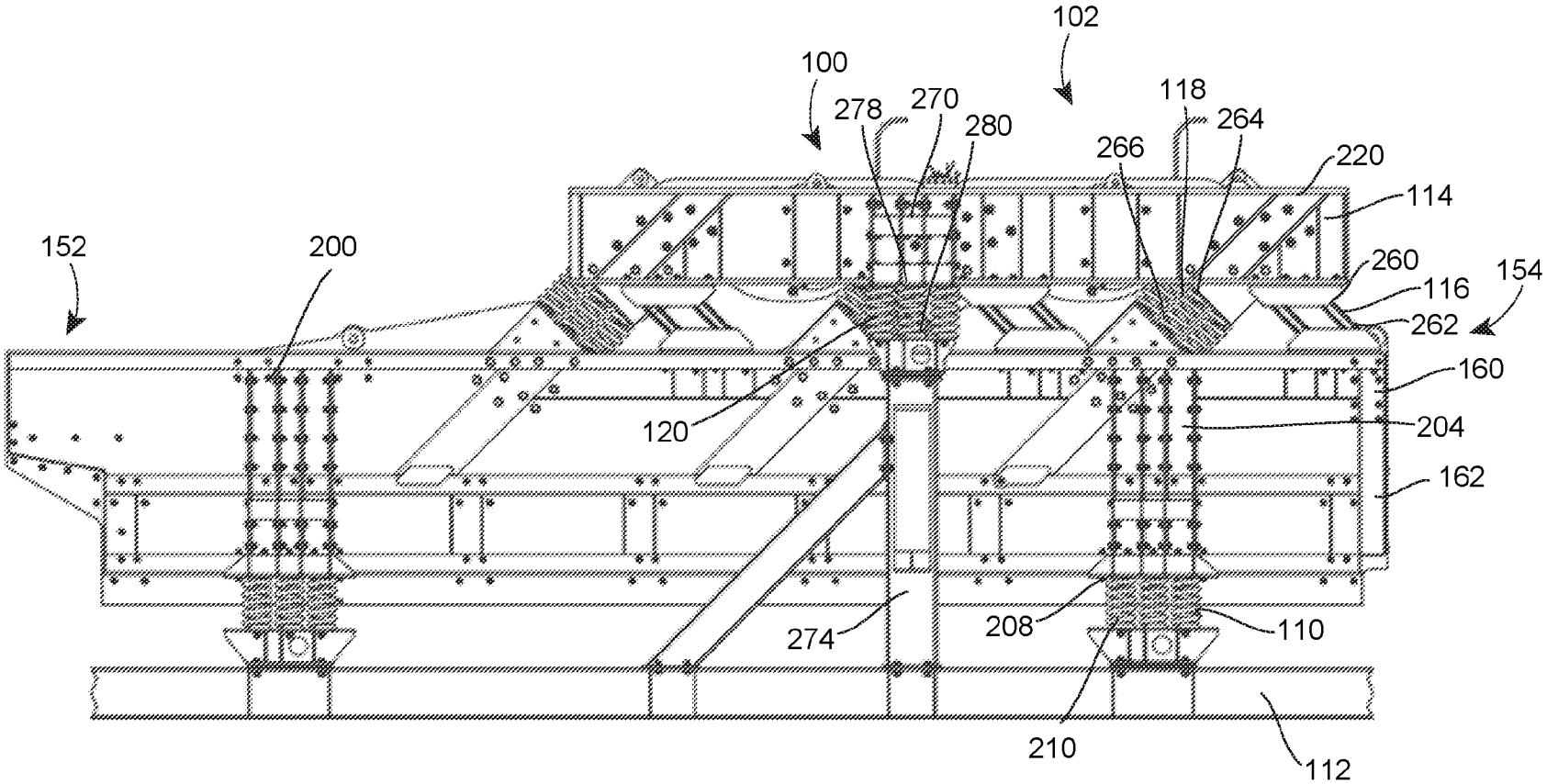
FIG. 2 is a left side view of the vibratory apparatus with dynamic balancer of FIG. 1.
Figure 3:
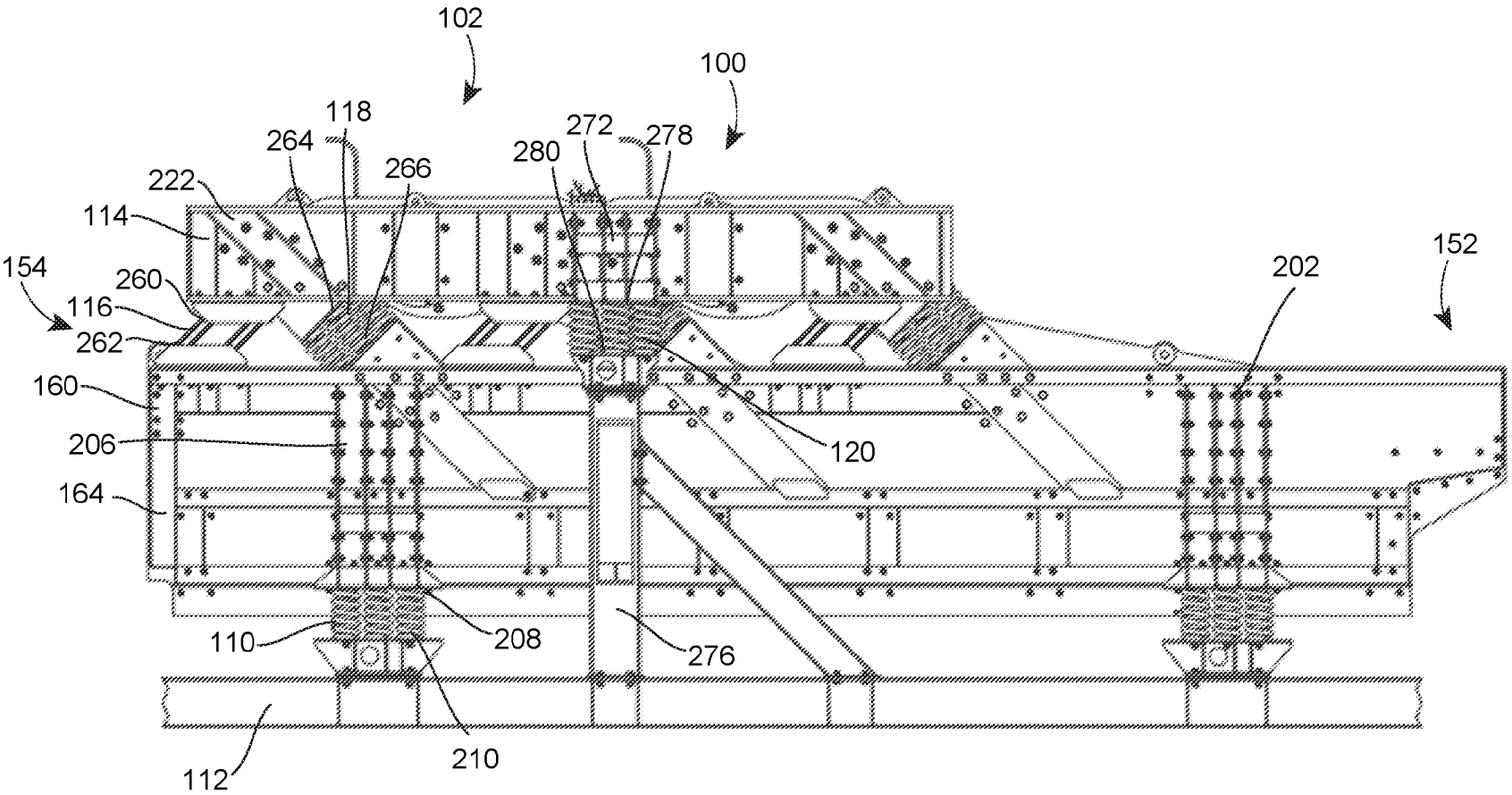
FIG. 3 is a right side view of the vibratory apparatus with dynamic balancer of FIG. 1.

FIGS. 1-3 illustrate a dynamic balancer 100 according to the present disclosure coupled to a vibratory apparatus 102, in the form of a vibratory screening apparatus, screener, or screen. The embodiment of the dynamic balancer 100 according to the present disclosure is not limited for use only with vibratory screeners or screens, but has been illustrated in combination with such a device for the purpose of better illustrating a system incorporating the dynamic balancer.

As illustrated, the vibratory screen 102 is a two-mass, sub-resonant frequency design. The screen 102 includes one or more decks 104, 106 supported by resilient members (e.g., coil springs, also referred to as isolation springs) 110 on a frame 112. While two decks 104, 106 are illustrated, the screen 102 might also have only one deck or more than two decks. The frame 112 is disposed on a foundation, which may be the ground story of a building or which may be an upper story of such a structure; in fact, vibratory screening units are typically mounted at the uppermost levels of the buildings in a mining processing plant, which elevations can exacerbate issues with the vibrations generated by such screens. An exciter 114 is coupled to the decks 104, 106 through an assembly of links 116 and resilient members (e.g., coil springs) 118.

The exciter 114, or first mass, is used to drive the decks 104, 106, or second mass, and thus the screen 102 may be referred to as a two-mass unit. One advantage of using a two-mass configuration is that the two-mass configuration responds positively to loading. That is, as the loading increases, the screen 102 will actually provide an increase in stroke, rather than a reduction in stroke (or dampening). As such, a two-mass screen of lower power requirements may be used in place of a direct-drive or brute force unit to process a similar loading, or a two-mass screen of similar power requirements may be used to process a much larger load.

The use of the two-mass configuration also provides another advantage, in that the operation of the unit itself may be used to significantly reduce the energy transmitted from the screen 102 to the surrounding environment, such as the building in which the screen 102 is disposed or mounted.

As suggested above, the resilient members or isolation springs 110 act to isolate the screen 102 from the foundation. That is, the resilient members 110 act to minimize the transmission of the dynamic forces generated during operation of the screen 102 to the frame 112 and the underlying foundation.

However, considering the potential disadvantages that may result from energy transmitted to the building as a consequence of operation of the vibratory screen 102, a dynamic balancer 100 according to the present disclosure may be used to further minimize the dynamic forces applied to the frame 112 and the building in which the screen 102 is disposed or mounted. In particular, it has been observed that in a vibratory apparatus as illustrated (i.e., a two-mass, sub-resonant frequency design), the decks 104, 106 and supporting structure (which may be referred to collectively as a trough) and the exciter 114 move 180 degrees out of phase with each other. As a consequence, by coupling the exciter 114 to ground through its own set of resilient members/isolation springs 120, the motion of the exciter 114 may be used to balance the loads applied to the frame 112 and the underlying foundation through the isolation springs 110. In this fashion, the dynamic loading of the frame 112 and the underlying foundation may be reduced so that a much larger screen 102 may be used than where no balancer 100 such as described herein is coupled to the screen 102.

This may have another consequence, in that the screen 102 may be operated at frequencies much closer to the natural frequency of the building in which the screen 102 is disposed or mounted. Conventionally, a screen will be operated at a frequency that is, for example, greater than $\sqrt{2}$ relative to the natural frequency of the building in which the screen is disposed or mounted. Through the use of the balancer 100 in combination with the two-mass, sub-resonant apparatus 102, the screen 102 may be operated at frequencies less than $\sqrt{2}$ of the natural frequency of the building.

Having thus described the balancer 100 and the apparatus 102 in general terms, the details of the apparatus 102 and the balancer 100 are provided below, returning first to FIG. 1.

The apparatus 102, as illustrated, is symmetrical about a longitudinal axis 150 that extends from an inlet end 152 to an outlet end 154. As a consequence, the side view illustrated in FIG. 2 is a mirror image of the side view illustrated in FIG. 3. For purposes of convenience only, the side view of FIG. 2 may be referred to as the left side view, and the side view of FIG. 3 may be referred to as the right side view.

The apparatus 102 has a trough 160 that includes the one or more decks 104, 106 and side walls 162, 164, the side walls 162, 164 parallel to the longitudinal axis 150 (within certain tolerances). The deck 104 (which may be referred to as an upper deck) may be joined at a first edge 166 to the side wall 162, and at a second edge 168 to the side wall 164. Similarly, the deck 106 (which may be referred to as a lower deck) may be joined at a first edge 170 to the side wall 162, and at a second edge 172 to the side wall 164. In particular, the edges 166, 170 may be attached to an inner surface of the side wall 162, while the edges 168, 172 may be attached to an inner surface of the side wall 164.

According to this embodiment, there may also be an intermediate wall 174 that divides the decks 104, 106 into first and second regions 176, 178 that extend between the inlet and outlet ends 152, 154. In fact, the decks 104, 106 may be divided into first and second subdecks, the first subdeck defining the first region 176 and the second subdeck defining the second region 178, and the first and second subdecks being attached at a first edge to either the side wall 162 or the side wall 164 and at a second edge to the intermediate wall 174. The first and second regions 176, 178 may be referred to as the left and right hand regions, as observed from the outlet end 154.

As illustrated, the deck 104 is disposed above the deck 106, and may have at least a first region that has a plurality of apertures or holes formed therethrough or that is defined by a mesh or other material having openings therethrough. This region of the deck 104 may also be referred to as foraminous, and the deck 104 may be referred to as a foraminous deck. Material that is larger than the apertures may pass along the deck 104 from the inlet end 152 to the outlet end 154, while material that is smaller than the apertures may fall through the deck 104 and be deposited on the deck 106. The material passing through the deck 104 may then pass along the deck 106 to the outlet end 154, although it is also possible for the deck 106 to have apertures or holes formed therethrough, or to be defined by a mesh or other material having openings therethrough. Where the deck 106 is the lowermost deck of the trough 160, the deck 106 may also be referred to as the floor of the trough 160.

The deck 104 may also have a second, initial region 190 that is does not have any apertures, holes, etc. This initial region 190 may be used to initially receive the material that will be passed over the decks 104, 106. The initial region 190 may be inclined relative to the remainder of the deck 104 so as to encourage the material disposed on the region 190 to move from the region 190 to the remainder of the deck 104.

The decks 104, 106 may have a liner disposed on a transporting surface thereof. The liner may include multiple plates, and may define, at least in part, the openings or apertures that pass through the deck 104, for example. In one exemplary embodiment, the liner may be used to increase the resistance of the decks 104, 106 to wear.

The trough 160 may also include one or more crossbeams or pairs of crossbeams that are attached to and depend between the side wall 162, 164. In an embodiment of the apparatus 102 such as is illustrated in FIGS. 2 and 3, wherein the trough 160 includes an intermediate wall 174, the crossbeams may be attached to the intermediate wall 174 as well. As illustrated, there are two pairs of crossbeams 192, 194 adjacent the inlet end 152, and a further pair 196 at the outlet end 154. The crossbeams 192, 194, 196 are spaced from the surface of the deck 104 so as to permit material to freely move along the surface of the deck 104.

The trough 160 may further include one or more mounting brackets 200, 202, 204, 206. The mounting brackets 200, 204 may be joined or attached to an outer surface of the side wall 162 (FIG. 2), while the mounting brackets 202, 206 are joined or attached to an outer surface of the side wall 164 (FIG. 3). The isolation springs 110 are attached at a first end 208 to one of the mounting brackets 200, 202, 204, 206 and at a second end 210 to the frame 112 (see, e.g., FIG. 2, bracket 204 or FIG. 3, bracket 206).

As mentioned above, the apparatus 100 also includes the exciter 114. The exciter 114 is coupled to the trough 160 (and the decks 104, 106) via the links 116 and reactor springs 118. In particular, the exciter 114 is supported on the first and second side walls or sides 162, 164 of the trough 160. The details of the exciter 114 are now discussed with reference first to FIG. 1.

The exciter 114 includes a frame with first and second side walls 220, 222 parallel to the longitudinal axis 150. The exciter 114 also includes three crossbeams 224, 226, 228 that are connected at opposite ends to an inner surface of the side walls 220, 222. The exciter 114 further includes two motor mounts 230, 232 that are attached to the crossbeams 224, 226, 228. As illustrated, the motor mount 230 is attached to and depends between the crossbeams 224, 226, and the motor mount 232 is attached to and depends between the crossbeams 226, 228. The motor mounts 230, 232 are attached to and depend between the crossbeams 224, 226, 228 at the midpoints of the crossbeams 224, 226, 228 (i.e., along the longitudinal axis 150 of the apparatus 102).

Figure 4:
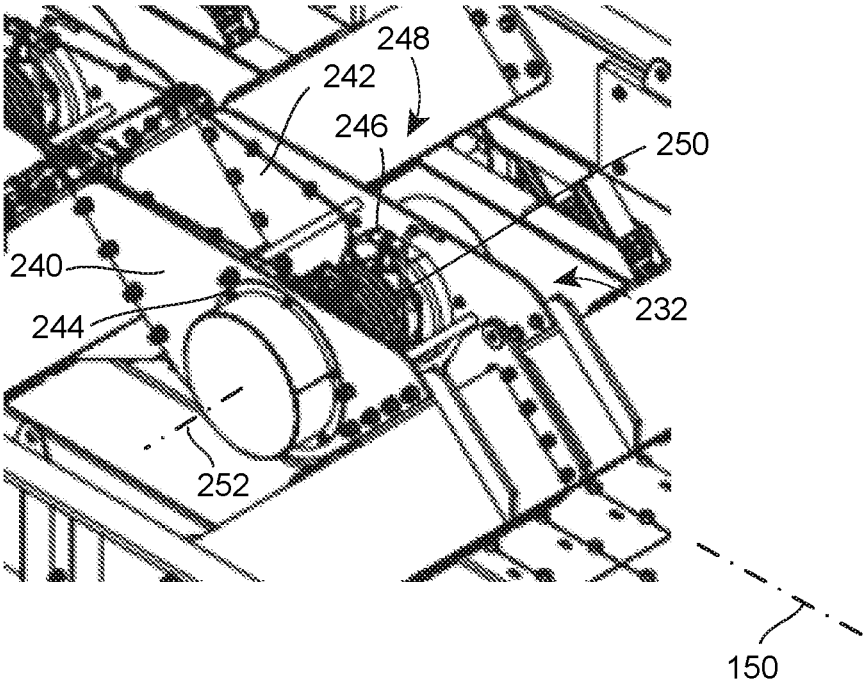
FIG. 4 is an enlarged, perspective view of a portion of the exciter of the apparatus of FIGS. 1-3.

The details of the motor mounts 230, 232 are now explained with reference to the motor mount 232 and FIG. 4, although a similar explanation would be applicable to the motor mount 230. The motor mount 232 includes first and second mounting plates 240, 242, each of which includes an opening 244, 246 for a motor assembly 248. The motor assembly 248 includes a motor 250 with a shaft disposed along an axis 252. The axis 252 of the motor 250 intersects the axis 150 of the apparatus 102 at an angle as viewed from above; as illustrated, the axes 150, 252 intersect at a right angle (i.e., the axes are orthogonal; the axis 252 may also be described as transverse to the longitudinal axis 150). A pair of eccentric weights is attached at either end of the motor shaft, and rotates about the axis 252.

As mentioned previously, the exciter 114 (or more particularly, the side walls 220, 222 or crossbeams 224, 226, 228 of the exciter 114) are attached to the decks 104, 106 (or more particularly, the side walls 162, 164 of the trough 160) via the links 116 and reactor springs 118. This is best seen in FIGS. 2 and 3. In particular, the links 116 and springs 118 are grouped into pairs, with each pair of links 116 and springs 118 inclined at opposing angles to the horizontal (for example, the links 116 may form an obtuse angle with the horizontal, while the paired springs 118 may form an acute angle with the horizontal). The links 116 may be attached at a first end 260 to the exciter 114 and a second end 262 to the trough 160, while the springs 118 may be attached at a first end 266 to the exciter 114 and a second end 264 to the trough 160. As such, the first side 162 is coupled to the first side 220 and the second side 164 is coupled to the second side 222 through the links 116 and springs 118.

Also attached to an outer surface of the side walls 220, 222 of the exciter 114 are mounting brackets 270, 272 (see FIGS. 2 and 3). Aligned with but spaced from each of the mounting brackets 270, 272 is a support bracket 274, 276 that is attached to the frame 112, and which brackets 274, 276 may be considered to be part of the frame 112. The isolation springs 120 are attached at a first end 278 to one of the brackets 270, 272, and at a second end 280 to one of the brackets 274, 276. The support brackets 274, 276 are sized to permit a relatively compact-sized spring 120 to be used, although it will be recognized that the exact dimensions of the support bracket 274, 276 may vary according to the requirements of the particular installation.

As will be recognized, the isolation springs 120 of the dynamic balancer 100 are disposed outwardly of the first and second side walls or sides 162, 164 of the trough 160 relative to the longitudinal axis 150 in a transverse direction (i.e., a direction orthogonal or at right angles to the longitudinal axis 150). In fact, the isolation springs 120 are also disposed outwardly of the first and second side walls or sides 220, 222 of the exciter 114 relative to the longitudinal axis 150 in a transverse direction. Thus, the mounting brackets 270, 272 and the support brackets 274, 276 are also disposed outwardly in a transverse direction as well.

While the balancer 100 is described in conjunction with the apparatus 102, it will be recognized that the balancer 100 need not be installed at the same time as the apparatus 102. That is, the balancer 100 may be attached to an apparatus 102 that has already been installed in a building, for example, where there it is desired to provide further isolation of the building from the apparatus 102. Consequently, the springs 120, the mounting brackets 270, 272, and the support brackets 274, 276 may be provided in the form of a kit for retrofitting an existing screen or apparatus 102. Accordingly, a method of retrofitting the apparatus 102 may include attaching the mounting brackets 270, 272 to the apparatus 102 (and in particular the side walls 220, 222 of the exciter 114), disposing the support brackets 274, 276 on ground (for example, by attaching the brackets 274, 276 to the frame 112), and disposing the springs 120 between the mounting brackets 270, 272 and the support brackets 274, 276.

A method of operating the vibratory apparatus 102 may also be described. In particular, the method includes operating a two-mass, sub-resonant frequency exciter 114 coupled to a trough 160, the trough 160 supported on a first plurality of isolation springs 110 disposed between the trough 160 and ground. As noted previously, the two-mass, sub-resonant frequency exciter 114 moves 180-degrees out of phase with the trough 160. The method also includes coupling the exciter 114 to ground through a dynamic balancer 100 comprising a plurality of isolation springs 120 disposed between the exciter 114 and ground. As a consequence, the forces applied to the ground by the apparatus 102 are balanced, and their effect on supporting or surrounding structures is minimized.

It will be recognized that operation of the two-mass, sub-resonant frequency exciter 114 may include operating at least one motor 250 mounted on the exciter 114, the motor 250 having a motor axis 252 transverse to a longitudinal axis 150 of the trough 160, which axis 150 extends between an inlet end 152 and an outlet end 154 of the trough 160, the motor 250 coupled to the trough 160 through at least one reactor spring 118. Alternatively or in addition, the motor 250 may be coupled to the trough 160 through at least one reactor spring 118 and at least one link 116. Further, the exciter 114 may be operated at a frequency that is less than $\sqrt{2}$ of a natural frequency of a building in which the apparatus 102 is disposed or mounted.

The method may also include depositing a material (such as rock or ore) on an upper foraminous deck 104 of the trough 160 at an inlet end 152 of the trough 160. According to such an embodiment, the method may also include separating the material into a first class that passes over the deck 104 between the inlet end 152 and an outlet end 154, and a second class that passes through the deck 104 with the exciter 114 operating.

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph, or 35 U.S.C. §112(f).

What is claimed is:

1. A method of balancing a vibratory apparatus, the method comprising: disposing the vibratory apparatus on a foundation, the vibratory apparatus comprising one or more decks resiliently supported relative to the foundation and a two-mass, sub-resonant frequency exciter attached to the one or more decks, the exciter comprising one or more motor assemblies that are attached to the one or more decks through a plurality of reactor springs attached at a first end to the exciter and a second end to the one or more decks; disposing a frame on the foundation about the vibratory apparatus; coupling a dynamic balancer comprising a plurality of isolation springs between the exciter and the frame, each of the plurality of isolation springs between the exciter and the frame, each of the plurality of isolation springs attached at a first end to the exciter and at a second end to the frame; and moving the decks and the exciter 180-degrees out of phase with each other.

2. The method of balancing a vibratory apparatus of claim 1, further comprising:

attaching mounting brackets to the exciter;

attaching support brackets to the frame; and disposing the springs between the mounting brackets and the support brackets.

3. The method of balancing a vibratory apparatus of claim 2, wherein the vibratory apparatus has a longitudinal axis and the exciter has first and second side walls relative to the longitudinal axis in a transverse direction, and wherein:

disposing the frame on the foundation comprises disposing the frame outwardly of the first and second side walls relative to the longitudinal axis in a transverse direction;

attaching the mounting brackets to the exciter comprises disposing the mounting brackets outwardly of the first and second side walls relative to the longitudinal axis in a transverse direction; and attaching the support brackets to the frame comprises disposing the support brackets outwardly of the first and second side walls relative to the longitudinal axis in a transverse direction.

4. A method of balancing a vibratory apparatus, the method comprising:

disposing the vibratory apparatus on a foundation, the vibratory apparatus having a longitudinal axis and comprising one or more decks resiliently supported relative to the foundation and a two-mass, sub-resonant frequency exciter attached to the one or more decks, the exciter comprising first and second side walls relative to the longitudinal axis in a transverse direction, disposing a frame on the foundation about the vibratory apparatus comprising disposing the frame outwardly of the first and second side walls relative to the longitudinal axis in a transverse direction;

attaching mounting brackets to the exciter comprising disposing the mounting brackets outwardly of the first and second side walls relative to the longitudinal axis in a transverse direction;

attaching support brackets to the frame comprising disposing the support brackets outwardly of the first and second side walls relative to the longitudinal axis in a transverse direction;

coupling a dynamic balancer comprising a plurality of isolation springs between the exciter and the frame, each of the plurality of isolation springs between the exciter and the frame, each of the plurality of isolation springs attached at a first end to the exciter and at a second end to the frame, wherein the plurality of isolation springs are disposed between the mounting brackets and the support brackets; and moving the decks and the exciter 180-degrees out of phase with each other.

* * * * *